US010094108B2

(12) United States Patent
Murao

(10) Patent No.: US 10,094,108 B2
(45) Date of Patent: Oct. 9, 2018

(54) SEISMIC SUSPENDED CEILING SYSTEM

(71) Applicant: Takehiro Murao, New York, NY (US)

(72) Inventor: Takehiro Murao, New York, NY (US)

( * ) Notice: Subject to any disclaimer, the term of this patent is extended or adjusted under 35 U.S.C. 154(b) by 0 days.

(21) Appl. No.: 15/084,487

(22) Filed: Mar. 30, 2016

(65) Prior Publication Data

US 2018/0163398 A1 Jun. 14, 2018

(51) Int. Cl.

| | |
|---|---|
| ***E04B 1/98*** | (2006.01) |
| ***E04B 9/06*** | (2006.01) |
| ***E04B 9/00*** | (2006.01) |
| ***E04B 9/18*** | (2006.01) |

(52) U.S. Cl.

CPC ..... *E04B 1/98* (2013.01); *E04B 9/006* (2013.01); *E04B 9/067* (2013.01); *E04B 2009/186* (2013.01)

(58) Field of Classification Search

CPC . E04B 1/98; E04B 9/006; E04B 9/067; E04B 2009/186

See application file for complete search history.

(56) References Cited

U.S. PATENT DOCUMENTS 2,710,679 A * 6/1955 Bibb ..... E04B 9/10 403/217
3,303,338 A * 2/1967 Lyon ..... F21S 8/02 362/148
3,912,865 A * 10/1975 Seebinger ..... E04B 9/006 248/343
4,408,428 A * 10/1983 Brooke ..... E04B 9/242 52/506.07
4,438,613 A * 3/1984 Hintsa ..... E04B 9/003 49/465
4,490,957 A * 1/1985 Bumpus ..... E04B 9/32 52/476
4,497,014 A * 1/1985 Woloski ..... E04B 9/006 362/150
4,760,677 A * 8/1988 Nassof ..... E04B 9/28 52/145
5,024,034 A * 6/1991 Gailey ..... E04B 9/247 52/506.07
5,253,463 A * 10/1993 Witmyer ..... E04B 9/24 52/506.07
5,428,930 A * 7/1995 Bagley ..... E04B 9/003 52/483.1
5,507,125 A * 4/1996 McClure ..... E04B 9/28 52/309.1
7,141,613 B2 * 11/2006 Albach ..... C08G 18/4081 252/182.24

(Continued)

*Primary Examiner* — Rodney Mintz
(74) *Attorney, Agent, or Firm* — James P. Demers

(57) ABSTRACT

The invention provides suspended or "dropped" ceiling systems based upon the use of standard inverted T-bar lattices. The ceiling panels are constructed from two pieces which, when assembled in place, capture the T-bar in a manner that prevents the panels from shaking loose. A suspended ceiling assembled with the panels of this invention will withstand the forces of an earthquake without experiencing panel drop-outs, and the ceiling will remain intact so long as the T-bars remain suspended from the structural ceiling above. The panels of the invention can, in preferred embodiments, carry lighting fixtures, and the required wiring can be installed and concealed below the T-bars rather than within the plenum space.

7 Claims, 7 Drawing Sheets

(56) References Cited

U.S. PATENT DOCUMENTS

| | | | | |
|---|---|---|---|---|
| 2004/0068953 | A1* | 4/2004 | Sauer | E04B 9/24 52/506.06 |
| 2004/0118068 | A1* | 6/2004 | Kliegle | E04B 9/003 52/483.1 |
| 2007/0193131 | A1* | 8/2007 | Ortiz | E04B 9/0435 52/144 |
| 2009/0139155 | A1* | 6/2009 | Kelders | E04B 9/006 52/101 |
| 2010/0064618 | A1* | 3/2010 | Boyd | E04B 9/24 52/506.07 |
| 2011/0078970 | A1* | 4/2011 | Boyd | E04B 9/241 52/506.07 |
| 2012/0023853 | A1* | 2/2012 | Gerkes | E04B 9/225 52/506.06 |
| 2015/0345139 | A1* | 12/2015 | Underkofler | E04B 9/003 52/506.08 |
| 2016/0017604 | A1* | 1/2016 | White | E04B 9/006 52/28 |
| 2016/0356430 | A1* | 12/2016 | Stratas | F21S 8/04 |
| 2017/0356625 | A1* | 12/2017 | Sorensen | F21V 11/02 |
| 2017/0356632 | A1* | 12/2017 | Rao | E04B 9/003 |

* cited by examiner

SEISMIC SUSPENDED CEILING SYSTEM

RELATED APPLICATIONS

There are no related or priority applications.

FIELD OF THE INVENTION

The present invention relates to suspended ceiling systems based upon the use of inverted "T-bar" lattices, and more particularly to ceiling panels which, when installed, cannot be shaken loose from the suspension lattice.

BACKGROUND

The majority of suspended or "dropped" ceiling construction in use today employs so-called T-bar rails, having the cross-section of an inverted "T", arranged in a rectilinear grid and suspended from the structural ceiling by tie wires or metal straps. The system is essentially that described in U.S. Pat. No. 2,710,679 (granted to Bibb et al. on Jun. 14, 1955), with minor modernizations. Rectangular ceiling tiles, generally either porous acoustic tile or decorative panels, are inserted between the T-bars at an angle, leveled, and dropped into the grid, where they rest on the horizontal flanges of the inverted "T". In the United States, the cell size in the suspension grid is typically either 24 in×24 in or 24 in×48 in, while in Europe and elsewhere the cell size in the suspension grids is 600 mm×600 mm (23.62 in×23.62 in) or 600 mm×1200 mm (23.62 in×47.24 in). The ceiling tiles are actually about 6 mm (¼ inch) smaller than the nominal (i.e., cell) size, to facilitate easy installation between the vertical stems of the T-bars.

The popularity of this construction is due to the ease and low cost of installation, and to the fact that the individual tiles are readily pushed up and off of the rails whenever access to the space above the ceiling is required, and can be returned to their original placement without damage. Tiles having any desired finish and appearance can be manufactured to fit into the standard T-bar grids, giving decorators and architects a wide range of design choices. Lighting fixtures and air diffusers and grilles, built to the same dimensions as the tiles, can be dropped into the grid wherever desired. Tiles and fixtures of the standard dimensions are commercially available from a wide range of sources.

One disadvantage of this system is that, in an earthquake, the tiles and fixtures can bounce up and off of the T-bar flanges, and then drop to the floor or onto the building's occupants, as a consequence of not being mechanically connected or attached to the T-bars. As tiles fall from their places, the suspended grid becomes flexible and prone to even greater movement and distortion, causing more tiles to fall; the result is often a progressive failure of the entire ceiling.

In earthquake-prone areas, seismic building codes often require splayed (diagonal) tie wires to be installed, to limit lateral motion and distortion of the grid during an earthquake. Vertical posts are sometimes installed as well, to limit vertical motion of the grid. Such preventive measures render the grid more rigid, and ensure that it moves along with (and not relative to) the building, but they add to the labor and expense of installation, and they do not entirely prevent individual tiles and fixtures from separating from the T-bars. Fixing the tiles to the T-bars, for example by installation of retention clips, is labor-intensive, and interferes with easy access to the space above the ceiling. Easily accessed clips tend to be visible, and can mar the aesthetics of the ceiling design. Safety mechanisms that "catch" falling tiles (e.g., U.S. Pat. No. 5,253,463 granted to Witmyer on Oct. 19, 1993) still permit the tiles to separate from the T-bars, and the grid can still suffer from the resulting loss of rigidity.

Tiles having a slot or kerf along the sides, into which the T-bar horizontal flanges are fitted, are known. Kerfed tiles are intended to conceal the grid, partially or completely, from view from below, and by virtue of being locked to the grid, they also have improved seismic resistance. Tiles having four kerfed sides are rarely employed, because they must be slid into place as the T-bar grid is being assembled, and they present an installation problem when the assembly process reaches a wall. There are kerfed tiles designed for installation in a pre-existing grid, which feature some combination of breaks in the flanges and/or the upper lips of the kerfs, that permit the tiles to be slid into place. Tiles featuring a small upper lip along two adjacent kerfs, that take advantage of the ¼-inch of leeway between tile and grid to enable installation, are known, but such tiles are not truly locked to the grid. Kerfed tiles having gaskets, that snap into place over and below the T-bar horizontals, are known (e.g., U.S. Pat. No. 4,760,677 granted to Nassof on Aug. 2, 1988, and U.S. Pat. No. 5,507,125 granted to McClure on Apr. 16, 1996). Removal of kerfed tiles without damage, for access to the space above the ceiling, can be difficult or impossible, particularly when the method of installation is not apparent to the person attempting the removal.

Separate frames intended to obscure the T-bar are known (e.g., U.S. Pat. No. 4,980,957 granted to Bumpus et al. on Jan. 1, 1985), but these frames, which serve only an aesthetic purpose, clip to the T-bar and do not secure the ceiling tile. There is a need for a suspended ceiling system that remains easy to install and maintain, but which does not drop tiles in the event of an earthquake. Similar needs exist in mobile environments, such as military and passenger ships, where ceiling structures are sometimes subjected to unusual forces and motions.

A feature of suspended ceilings is the air space, or plenum, between the suspended tiles and the structural ceiling above. If ductwork for both a forced-air supply and forced-air return is installed, the airspace is "dead", i.e., filled with non-circulating air. In the absence of return air ducts, the plenum is usually provided with an exit duct, and the space above the tiles is an "active" plenum filled with circulating air. Electrical wiring installed in an active plenum can represent a fire hazard, because toxic gases and smoke from burning insulation and plastics are not contained, as they would be in a dead airspace, but are passed directly into the building's air circulation system. Another hazard is that a fire in a plenum space could spread rapidly before being detected, if combustible materials are present.

When the airspace above a dropped ceiling is used as an active plenum, construction standards and/or local fire regulations require low-voltage cables and wiring either to be installed inside metal conduit, or else provided with low-smoke/low-toxicity wire insulation which does not support combustion on its own. Twisted pair and coaxial cables, for telephone and data network services, are the most common form of wiring found above ceilings in commercial buildings. Specialized plenum (or plenum-rated) cable is referred to as Low Smoke Zero Halogen (LSZH or LSOH) cable. Plenum-rated cable is generally insulated and sheathed with fluorocarbon polymers, which makes it significantly more costly than equivalent non-plenum-rated wiring, which typically has inexpensive polyethylene insulation and PVC sheathing.

High-voltage electrical equipment and wiring (generally, >50 volts) above a ceiling is required to be enclosed in metal conduit or raceways, and must be physically isolated from low-voltage wiring. Devices and fixtures, such as lighting fixtures, must be enclosed in metallic boxes. Electrical outlets are permitted inside the plenum space (if enclosed within electrical boxes), but because the sockets themselves must be located on the exterior of the dropped ceiling, plug-in connection of fixtures is impractical. The overall result is that all fixtures and devices installed in a ceiling must be hard-wired, using metal conduits and junction boxes.

Meeting these construction and fire codes adds substantially to the time and cost of installation, as the conduit and boxes represent added capital costs, and require a considerable amount of skilled labor to install. It is particularly difficult and costly to add high-voltage wiring to a previously installed system. There is a need for suspended ceilings that can safely be wired without the added expense of conduit, junction boxes, and plenum-rated wiring, and which permit the plug-in connection of electrical fixtures.

SUMMARY OF THE INVENTION

The present invention provides ceiling panels that comprise an upper frame, and a reversibly attached lower frame. The upper frame is sized and configured to be installed on a suspended T-bar grid in the usual manner. Once the upper frame has been placed on the T-bar horizontals, the lower frame is mechanically locked to the upper frame to complete the installation. The lower frame is sized to at least partially cover the T-bar horizontals, so that the two frames, when locked together, are functionally equivalent to a kerfed tile. In a ceiling constructed from these panels, the T-bar flanges are trapped between the frames, and cannot separate from the panels when the ceiling is rocked or shaken.

When two ceiling panels of the invention are installed in adjacent cells of the T-bar grid, the sides of the panels, together, define a channel that is at least large enough to enclose and capture the T-bar horizontal flanges. In preferred embodiments, this channel comprises additional space below the T-bar. In alternative embodiments, a second channel is defined. This additional space (or second channel), being below and outside of the plenum space, serves as a utility channel that can carry non-plenum-rated wiring, cabling, and fixtures. The channels between adjacent panels of the invention align with the channels between neighboring panels, creating extended utility channels that run the full length and width of the ceiling.

The present invention provides suspended ceilings that comprise a suspended grid of inverted T-bars, upper frames fitted between the vertical stems and resting upon the horizontal flanges of the T-bar grid; and lower frames reversibly attached to the upper frames, wherein adjacent lower frames together with the adjacent upper frames to which they are attached define channels that partially or completely enclose the horizontal flanges of the T-bars upon which the upper frames are resting.

The invention also provides a method of constructing a suspended ceiling, comprising the steps of suspending an inverted grid of T-bars from an existing ceiling, installing between the vertical stems of the T-bar grid upper frames that rest upon the horizontal flanges of the T-bars; and reversibly attaching lower frames to the upper frames, wherein adjacent lower frames together with the adjacent upper frames to which they are attached define channels that partially or completely enclose the horizontal flanges of the T-bars upon which the upper frames are resting.

DETAILED DESCRIPTION OF THE INVENTION

Figure 1:
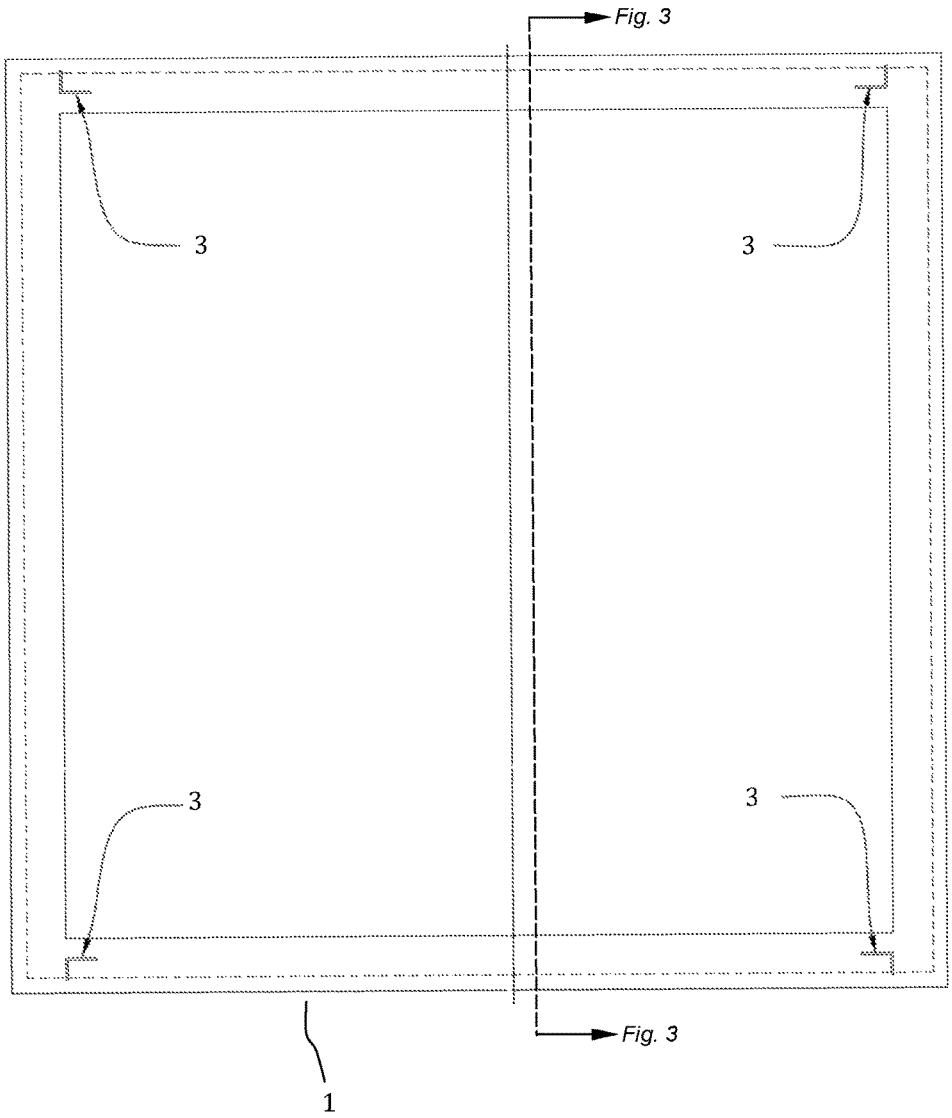
FIG. 1 shows a top view of an exemplary upper frame of the invention.

The present invention provides ceiling panels for installation in a grid of suspended T-bars. A panel of the invention comprises an upper frame, sized to fit between the verticals and rest upon the horizontals of the gridded T-bars, and a lower frame that is reversibly attachable to the upper frame when the upper frame is resting upon the horizontals of the T-bar grid. The invention is characterized by the fact that the lower frame, when attached to the upper frame, forms together with the upper frame a channel that at least partially encloses the horizontals of the T-bar upon which the upper frame is resting. When the horizontals on both sides of the T-bar are thus enclosed, the horizontals cannot escape the channels when the panels are set in motion by a seismic event. The panels themselves cannot be separated from the T-bars, and will remain suspended so long as the T-bar grid itself remains suspended.

Various known-in-the-art means of reversibly attaching the upper and lower frames can be employed, such as for example magnetic couplings, hook-and-loop fabric strips or patches, spring-biased clips and snaps, and screws. In general, the preferred means of attachment are mechanical means which are not susceptible to detachment under the forces applied during an earthquake, yet are readily reversed by workers whenever a panel must be removed for inspection, maintenance, or modification of the ceiling or plenum. Such attachments are referred to herein as "locked" or "locking" attachments. In a particularly preferred embodiment, as illustrated in the present drawings, the ceiling panels of the invention have the lower frame attached to the upper frame by means of spring wire retainer clips, the clips being attached to one frame and engaging with and snapping into slots in the other frame. The frames can be separated only when the wire clips are manually released. Quick-release (e.g. half-turn or quarter-turn) screws are another preferred means of reversible attachment. Captive screws will be particularly preferred.

In other preferred embodiments, the ceiling panels of the invention may comprise lighting fixtures or elements, and associated hardware such as mounting brackets, heat sinks, and diffusers. The lighting elements are preferably LED lighting elements affixed to either of the frames. Wiring for the LED elements may optionally be affixed to either of the frames, and/or the wiring may be run between the frames. Electrical components are preferably located below the plane defined by the T-bar horizontals, where less-expensive non-plenum-rated components can be safely installed.

In preferred embodiments, the panels define a space between one another, below the T-bar horizontals, which serves as a utility channel. Non-plenum-rated wiring and cabling, such as for example telephone, Ethernet, and co-axial cabling, can safely be installed in the utility channel, which lies outside of the plenum. Other devices which can be installed along with their wiring include wireless routers and repeaters, smoke detectors, fire alarms, security cameras, and the like.

The upper and lower frames can be manufactured from any material customarily employed in the manufacture of ceiling tiles and panels. Preferable materials are fiberglass composites and rigid polymer foams, which can be formed in molds and then further shaped, if necessary, by machining. Rigid, closed-cell polyurethane foams are particularly preferred. Polyurethane foams are produced by reacting a di- or polyisocyanate with isocyanate-reactive diols or polyols, generally in the presence of one or more blowing agents, catalysts, surfactants and other additives.

In general, any binary "A/B" polyurethane foam system that produces a rigid foam can be employed, and there are numerous commercially-available systems that are suitable. Preferably the cured foam is a closed-cell foam having a density of between 2 and 8 lbs/cubic foot. By way of example, a flame-resistant binary "A/B" pourable urethane foam precursor can be prepared according to U.S. Pat. No. 7,141,613 (granted to Albach et al. on Nov. 28, 2006). Preferred isocyanate precursors include 4,4'diphenylmethane diisocyanate, polymethylene polyphenyl isocyanate, and mixtures thereof. Preferred polyol components include polyalkylene ether polyols and alkoxylated and non-alkoxylated Mannich polyols. To confer fire-retardant properties, any polyurethane-compatible flame retardant known in the art may be employed, such as for example tris(1-chloro-2-propyl)phosphate. As a blowing agent, water is preferred, but it may be supplemented with known blowing agents such as hydrocarbons, hydrofluorocarbons, or alkyl formates. Rigid "architectural" polyurethane foams that meet or exceed building construction and fire standards are well-known to those of skill in the art, and these will be especially preferred in the present invention.

Figure 2:
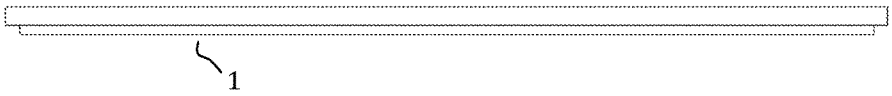
FIG. 2 shows a side view of an exemplary upper frame of the invention.
Figure 3:
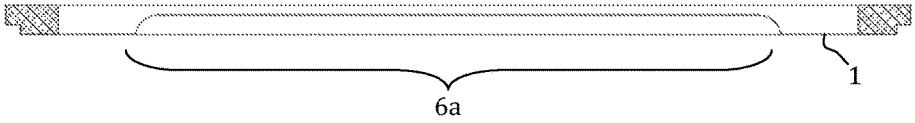
FIG. 3 shows a cross-section of an exemplary upper frame of the invention.
Figure 4:
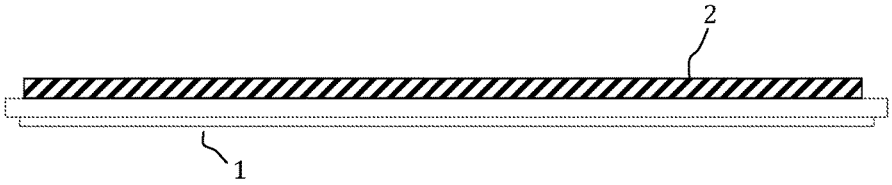
FIG. 4 shows a side view of an alternative embodiment of an upper frame of the invention.
Figure 5:
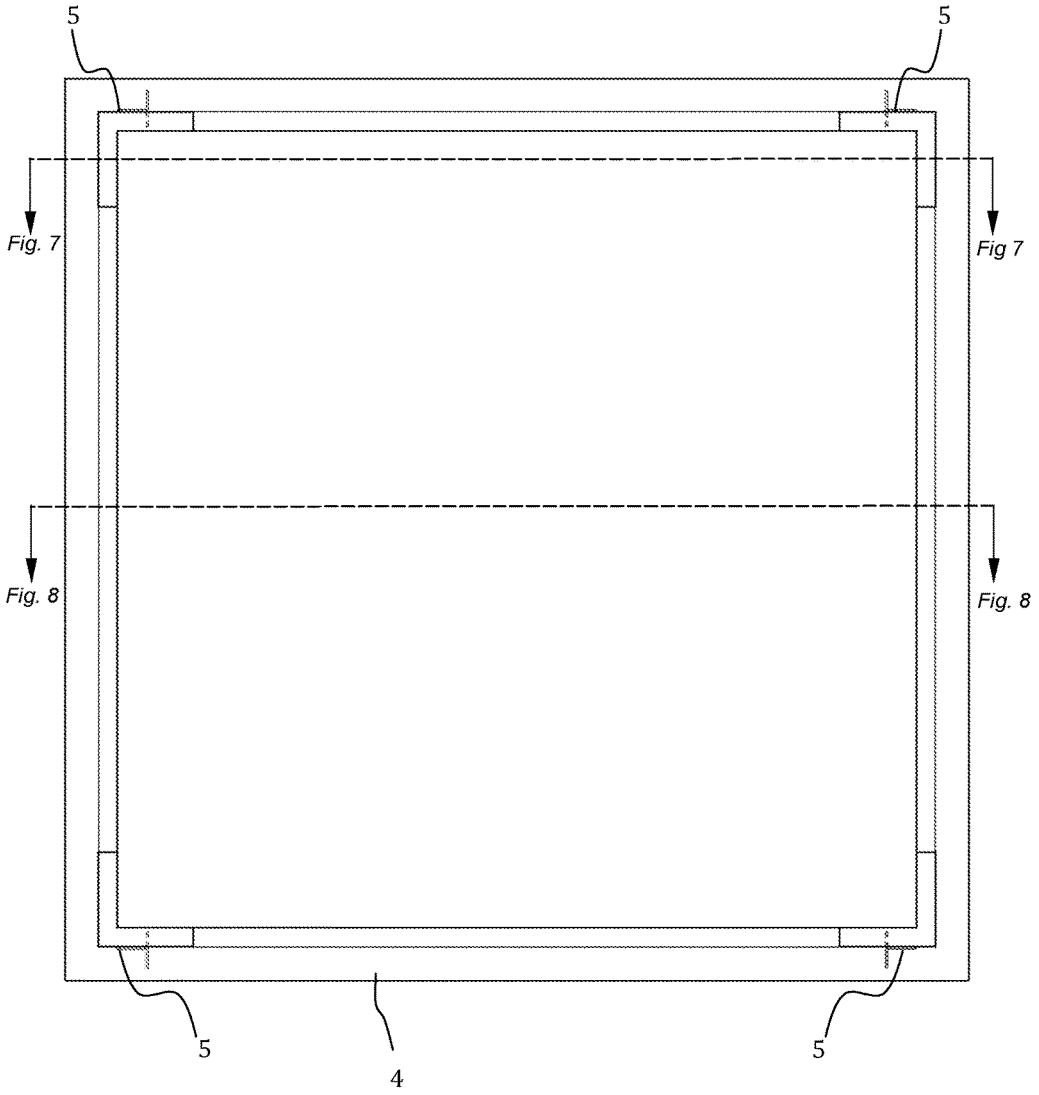
FIG. 5 shows a top view of an exemplary lower frame of the invention.
Figure 6:
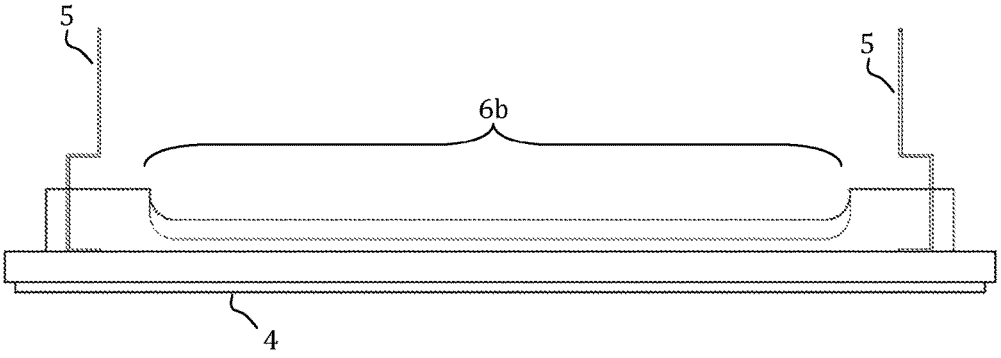
FIG. 6 shows a side view of an exemplary lower frame of the invention.

Turning to the drawings, FIGS. 1, 2 and 3 show a top view, side view and cross-section, respectively, of an exemplary upper frame 1. In the interest of clarity in the drawings, the embodiment that is illustrated in FIGS. 1-3 has an open upper frame, but it can be closed off with any type of decorative panel 2, as shown in the alternative embodiment of FIG. 4, so as to form a coffered ceiling when installed on the T-bar flanges. The decorative panel may be co-formed with, and integral with, the upper frame, or it may be formed separately, from any material known in the art to be suitable for use in the construction of suspended ceilings, and attached to the upper frame by routine means, including but not limited to adhesives, staples, screws, clips, and the like. Acoustic tile, or metal or plastic sheeting shaped or sculpted for aesthetic appeal, are particularly contemplated. The decorative panel 2 may be fitted with conventional lighting or ventilation fixtures, as is known in the art. Acoustic and/or thermal insulating materials (not shown) may be attached to the upper surface of the decorative panel. In the embodiment shown, which is adapted for the use of wire clips to attach the lower frame as disclosed further below, L-shaped slots 3 are formed into or cut through the upper frame near each corner. An optional cut-out 6*a* is shown; these cutouts are discussed below in connection with FIG. 6.

FIGS. 5, 6, 7 and 8 show a top view, side view and two cross-sections, respectively, of an exemplary lower frame 4. In the embodiment shown, wire form spring clips 5 are attached to the lower frame, and these serve as the means of reversibly attaching the lower frame to the upper frame. Suitable wire forms can be manufactured from any resilient metal wire known in the art to be suitable for wire spring clips, such as for example the 0.03-inch diameter piano wire used in this particular embodiment. An optional cut-out 6*b* is shown; these cutouts are preferably present on all four sides of the lower frame. The cutouts 6*b* align with the cutouts 6*a* in the upper frame, and together form an aperture 6 (FIG. 13) that allows indirect lighting to be directed upwards from lighting elements (not shown) installed within the utility channel. The lighting elements are preferably LED lamps with their associated wiring, and they are preferably installed on a circuit board that is attached to the lower frame. Such circuit boards can advantageously be pre-installed on the lower frame, so that lighting is installed at the same time the ceiling is installed. The installer of ceiling panels corresponding to this embodiment needs only to plug the LED wiring into an outlet connected to a power supply cable running within the utility channel 8 (FIG. 13), to effect a complete and code-compliant installation of the ceiling's lighting.

Figure 9:
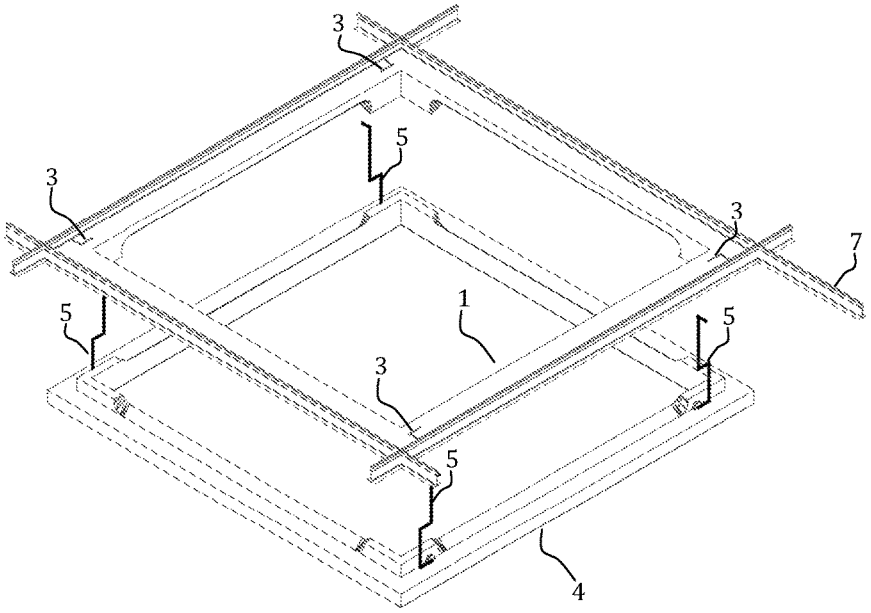
FIG. 9 is a perspective drawing showing upper and lower frames of the invention, positioned on a T-bar grid.
Figure 10:
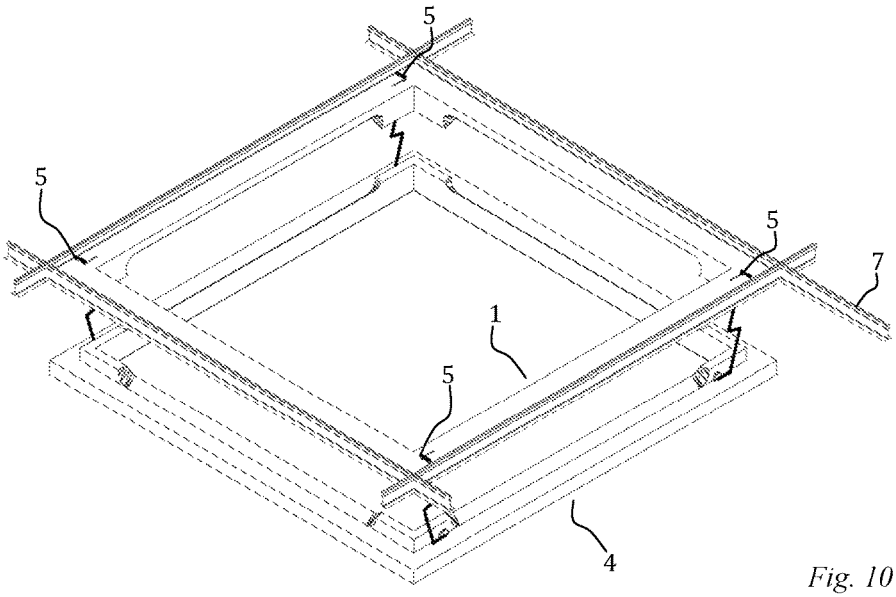
FIG. 10 is a perspective drawing showing a connected set of upper and lower frames of the invention on a T-bar grid.
Figure 11:
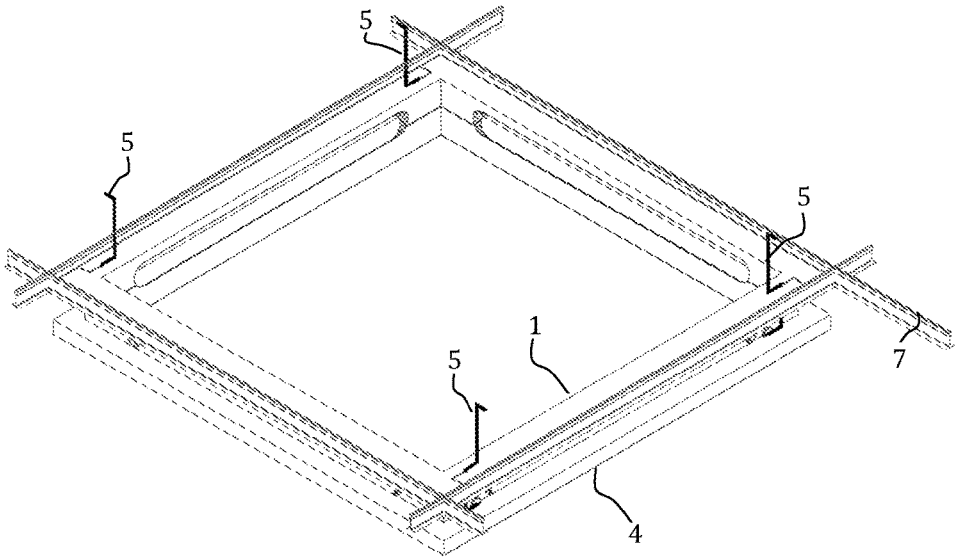
FIG. 11 is a perspective drawing showing a set of upper and lower frames of the invention, assembled on a T-bar grid to form a ceiling panel of the invention.

Turning now to FIGS. 9-11, the installation and in situ assembly of a ceiling panel, according to one embodiment of the invention, is illustrated in perspective views. Initially, as shown in FIG. 9, upper frame 1 is installed on a T-bar grid 7 in the usual manner, so that it rests on the upper surfaces of the T-bar flanges. The upper frame is penetrated by four L-shaped slots 3. Lower frame 4 is shown with four wire form spring clips 5 attached near each corner. The wire spring clips stand vertically, and feature a first horizontal segment at the upper end, and a second horizontal segment at right angles to the first, located near the mid-point of the wire. Viewed end-on, the first and second horizontal segments project an L shape, which is dimensioned and oriented so as to align with the L-shaped slots 3 in upper frame 1. The precise location of the slots 3 in the upper frame 1, and the precise location of the wire spring clips 5 on the lower frame 4, are not critical, so long as they align when the frames are brought together. For maximum stability of the installed panels, an arrangement close to the corners is preferred. For ease of installation, a symmetric arrangement of the slots and wires is preferred.

To install the panel into the T-bar grid, the first horizontal segment of each of the wire spring clips 5 is inserted into a parallel limb of each of the complimentary L-shaped slots 3. The lower frame 4 is then moved upwards, until the first horizontal segments of the wire spring clips pass through upper frame 1 and emerge from the slots 3. The wire spring clips are preferably biased so that each first horizontal segment, upon emerging from its corresponding slot, is displaced away from the slot. The arrangement is now as shown in FIG. 10, where the lower frame 4 is shown hanging from the upper frame 1 by the four wire spring clips 5. In this configuration, the installation of additional features such as wiring and electrical components, and the making of electrical connections, may be carried out.

To complete the assembly and installation of the panel, the lower frame is pressed further upwards, until the second horizontal segments of the spring wire clips 5 emerge from slots 3. The wire spring is inwardly biased, in a direction parallel to the side of the frame, so that the second horizontal segment, upon clearing the slot 3, is displaced away from the slot. The lower frame now hangs from the upper frame as shown in FIG. 11, with its weight borne by the four second horizontal segments. In this configuration, the four wire spring clips are locked into the positions shown by the biasing force of the wire spring itself. In this locked configuration, the two frames are in contact, or nearly so, so that the locked-together frames act as a rigid unit that cannot be displaced from the T-bar.

Figure 12:
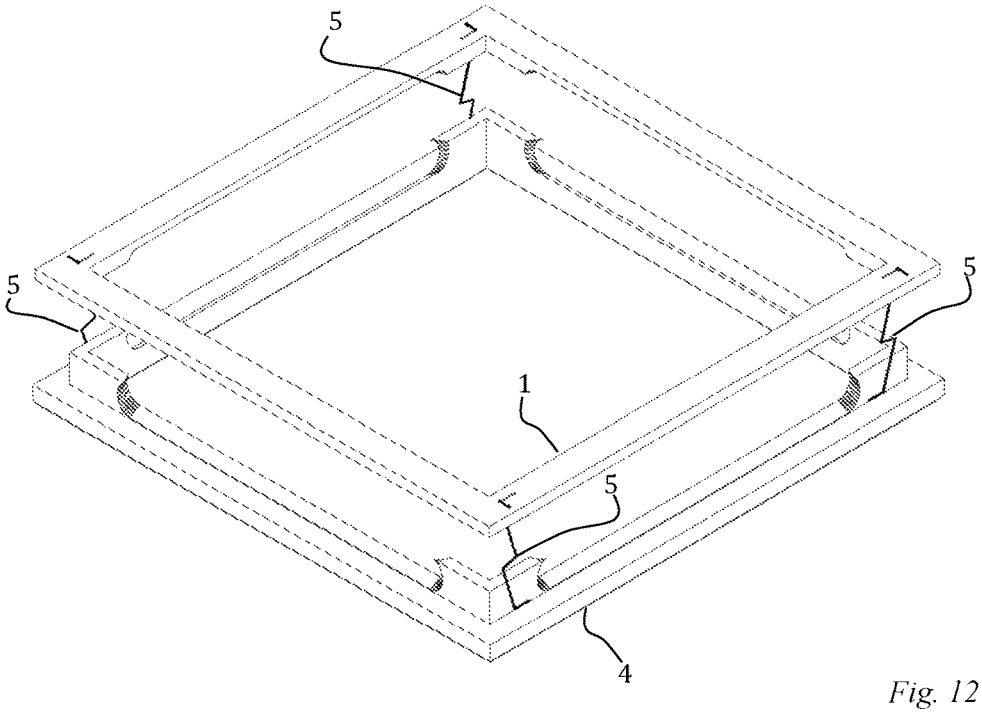
FIG. 12 is the perspective drawing of FIG. 10, with the T-bar grid removed for clarity.

In preferred embodiments, the distance between the frames in the configuration of FIG. 10 is large enough to permit placement of the upper frame onto the T-bar grid, after the lower frame has been connected via the wire clips as shown in FIG. 12. This mode of installation consists of simply placing the upper frame of the assembly shown in FIG. 12 onto the T-bar grid, arriving at the arrangement shown in FIG. 10. After making any necessary electrical connections, the two frames are pressed together, as described above, until the wire clips snap into place.

The frames may be separated, and the panel uninstalled, by manually displacing the wire spring clips 5 so that the second horizontal segments drop back into their corresponding slots, and then allowing the lower frame to drop down, returning the frames to the configuration shown in FIG. 10. Reversal of the installation is straightforward from this point, and the upper frame may be removed from the grid, and then re-installed at a later time without damage.

Figure 7:
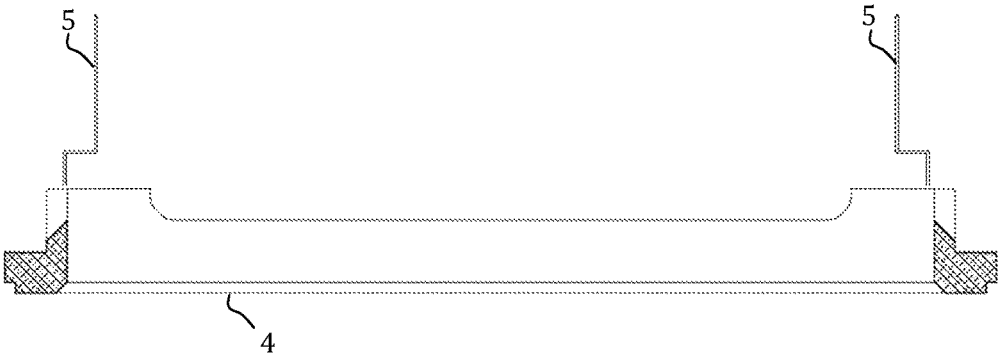
FIG. 7 shows a cross-section of an exemplary lower frame of the invention.
Figure 8:
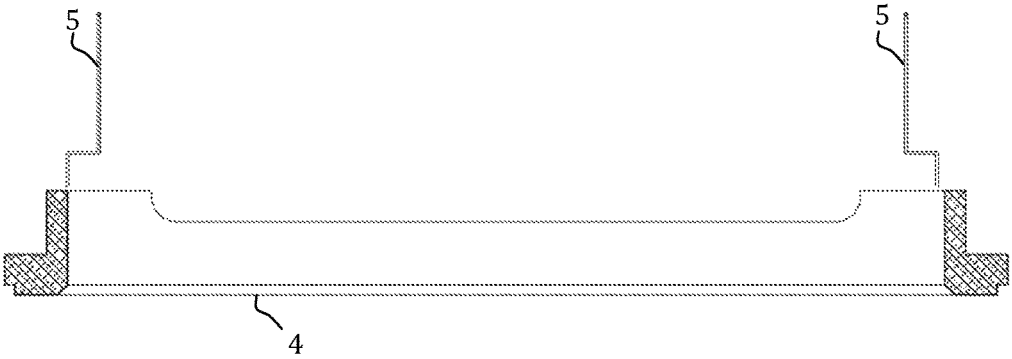
FIG. 8 shows a different cross-section of an exemplary lower frame of the invention.
Figure 13:
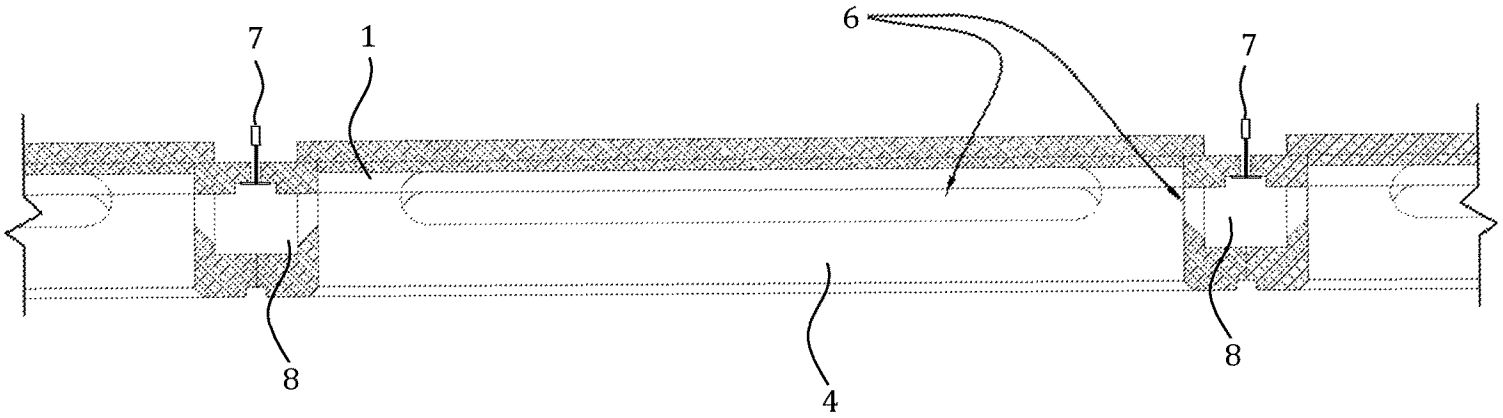
FIG. 13 shows a cross-section of ceiling panels of the invention installed on and supported by a T-bar grid.

FIG. 13 shows a cross section of ceiling panels of the invention, essentially along the lines of FIGS. 3 and 7, which have been assembled from upper frames 1 and lower frames 4 as described above, and suspended from T-bars 7. The wire clips 5 are omitted from this view. In this embodiment, the sides of adjacent panels together define a utility channel 8 directly below the T-bar. In an alternative embodiment (not shown), the sides of adjacent panels define a utility channel separate from the channel enclosing the T-bar 7. As can be seen from FIG. 13, the utility channel 8 lies below the T-bar grid and is not within the plenum space above the ceiling. This location outside of the plenum makes possible the installation of non-plenum-rated wire and cable, and simple plug connectors for lighting fixtures, without the need for metal conduit, raceways, and junction boxes. The cut-outs 6*a* and 6*b* (see FIGS. 3 and 6) align to define aperture 6, which can be used to admit light from lighting elements mounted within utility channel 8.

The drawings and descriptions provided with this specification are intended to be illustrative, and are not intended to convey limitations on the scope of the invention. Modifications and alterations will be obvious to those of skill in the art, and such modifications and alterations are intended to be within the scope of the invention.

I claim:

1. A ceiling panel for installation in a grid of suspended T-bars having vertical stems and horizontal flanges, the panel comprising:

(a) an upper mounting frame configured to fit between the vertical stems and directly rest upon the horizontal flanges of the T-bar grid, and (b) a structurally independent lower frame reversibly attached to the upper frame;

wherein the lower frame is reversibly attached to the upper frame by magnetic or mechanical fastening means, the magnetic or mechanical fastening means being attached to one of the upper or lower frame and reversibly engaging with an other of the upper or lower frame;

wherein the lower frame, together with the upper frame defines a channel that at least partially encloses the horizontal flange of the T-bar upon which the upper frame is resting.

2. The ceiling panel according to claim 1, wherein the mechanical fastening means is spring wire retainer clips, the clips being attached to the one frame and reversibly engaging with slots in the other frame.

3. The ceiling panel according to claim 1, further comprising LED lighting elements affixed to one of the frames.

4. A suspended ceiling, comprising:

(a) a suspended grid of inverted T-bars having vertical stems and horizontal flanges;

(b) upper mounting frames positioned between the vertical stems and directly resting upon the horizontal flanges of the T-bar grid; and (c) structurally independent lower frames reversibly attached to the upper frames, wherein the lower frames are reversibly attached to the upper frames by magnetic or mechanical fastening means, the magnetic or mechanical fastening means being attached to one of the upper or lower frames and reversibly engaging with an other of the upper or lower frames;

wherein adjacent said lower frames together with adjacent said upper frames to which the lower frames are attached define channels that at least partially enclose the horizontal flanges of the T-bars upon which the upper frames are resting.

5. The suspended ceiling according to claim 4, wherein the channels entirely enclose the horizontal flanges of the T-bars upon which the upper frames are resting.

6. A method of constructing a suspended ceiling, comprising the steps of:

(a) suspending an inverted grid of T-bars from an existing ceiling, the T-bars comprising vertical stems and horizontal flanges;

(b) installing upper mounting frames between the vertical stems of the T-bar grid, the upper frames directly resting upon the horizontal flanges of the T-bars; and (c) reversibly attaching structurally independent lower frames to the upper frames by magnetic or mechanical fastening means, the magnetic or mechanical fastening means being attached to one of the upper or lower frames and reversibly engaging with an other of the upper or lower frames;

wherein adjacent said lower frames together with adjacent said upper frames to which the lower frames are attached define channels that at least partially enclose the horizontal flanges of the T-bars upon which the upper frames are resting.

7. The method according to claim 6, wherein the channels entirely enclose the horizontal flanges of the T-bars upon which the upper frames are resting.

* * * * *